United States Patent [19]

Egee

[11] 4,453,368

[45] Jun. 12, 1984

[54] METHOD AND APPARATUS FOR AUTOMATICALLY PACKING ELONGATED FOOD ARTICLES IN CONTROLLED POSITIONS AND ORIENTATIONS

[75] Inventor: Walter W. Egee, Wallingford, Pa.

[73] Assignee: Campbell Soup Company, Camden, N.J.

[21] Appl. No.: 373,694

[22] Filed: Apr. 30, 1982

Related U.S. Application Data

[63] Continuation-in-part of Ser. No. 286,597, Jul. 24, 1981, abandoned.

[51] Int. Cl.[3] ..... B65B 19/34; B65B 63/04

[52] U.S. Cl. ..... 53/430; 53/444; 53/473; 53/116; 53/515; 53/148; 53/236; 53/252; 198/418; 198/434; 426/392

[58] Field of Search ..... 53/116, 118, 215, 252, 53/236, 148, 444, 930, 435, 515, 517, 587, 591, 473; 198/841, 418, 434; 426/392, 397

[56] References Cited

U.S. PATENT DOCUMENTS

| | | | |
|---|---|---|---|
| Re. 27,852 | 12/1973 | Eisenberg | 53/515 |
| 8,202 | 7/1851 | Crosby | 53/591 |
| 1,987,482 | 1/1935 | Mandell | 53/215 |
| 2,157,765 | 5/1939 | Lanter | 53/118 X |
| 2,386,943 | 10/1943 | Fourness | 53/215 |
| 2,518,757 | 8/1950 | Coley | 53/515 |
| 2,821,347 | 1/1958 | Stephens | 53/215 X |
| 3,133,386 | 5/1964 | Johnston | 53/118 X |
| 3,461,646 | 8/1969 | Lane | 53/515 |
| 3,468,098 | 9/1969 | Eisenberg | 53/515 X |
| 3,658,273 | 4/1972 | Chapois | 53/118 X |
| 3,669,247 | 6/1972 | Pulver | 198/841 |
| 3,800,938 | 4/1974 | Stone | 198/841 |
| 3,964,235 | 6/1976 | Miller | 53/118 |
| 4,063,693 | 12/1977 | Achepohl | 53/118 X |
| 4,222,983 | 9/1980 | Wooten | 198/841 |

FOREIGN PATENT DOCUMENTS

| | | | |
|---|---|---|---|
| 578030 | 6/1959 | Canada | 53/430 |
| 477059 | 3/1976 | U.S.S.R. | 53/252 |

*Primary Examiner*—John Sipos
*Attorney, Agent, or Firm*—Albert L. Free

[57] ABSTRACT

Method and apparatus for packing cut pickle spears in a jar in predetermined positions and orientations by laying the spears side-by-side on a flexible resilient belt, rolling up the belt with the spears on it to form a cylinder, and pushing the cylindrical array of spears out of the rolled up belt into the jar.

8 Claims, 27 Drawing Figures

METHOD AND APPARATUS FOR AUTOMATICALLY PACKING ELONGATED FOOD ARTICLES IN CONTROLLED POSITIONS AND ORIENTATIONS

RELATED PATENT APPLICATIONS

This application is a continuation-in-part of copending application Ser. No. 286,597 of Walter W. Egee, filed July 24, 1981 now abandoned and bearing the same title as this application.

BACKGROUND OF THE INVENTION

There are a number of situations in which it is desired to pack elongated food articles into a container in controlled positions and orientations. One particular application of the invention, with respect to which it will be described in detail hereinafter, involves the packing of cut pickle spears into cylindrical containers, such as the usual pickle jar. From the view point of attractiveness and saleability of product, it has been found desirable to pack pickle spears into transparent jars with the same cut face of each spear facing outwardly so as to be visible through the jar, and to line up the spears, side by side, in this orientation around the periphery of the jar. Usually the thickness of the spears compared to the diameter of the jar is such that the peripherally-positioned spears leave a generally circular empty region in the middle of the jar which is then often filled with other pickle spears in any desired orientation.

Machines intended to accomplish this general purpose are disclosed in U.S. Pat. No. 3,461,646 of Lane et al, issued Aug. 19, 1969; U.S. Pat. No. 3,468,098 of Eisenberg, issued Sept. 23, 1969; and U.S. Pat. No. 27,852 of Eisenberg, issued Dec. 25, 1973. In these devices the pickle spears are fed downwardly through the top opening of the jar, and are individually controlled to assure that they are placed in the desired orientations and positions in the jar. Systems similar to those of the last two cited patents have been used commercially, but the arrangements shown in all three of these patents are quite complex, particularly with respect to the manner in which the individual spears are delivered to the packing position and then controlled so as to obtain the desired orientations and positions in the jar.

It is therefore desirable to provide a method and apparatus for the packing into a container of elongated food products, of which pickle spears are an example, in a way which is quick, simple and reliable, and, in certain important applications, so that the food products will be packed into the container in predetermined positions and orientations about their longitudinal axis. More particularly, it is desirable to provide a method and apparatus which accomplishes the packing of cut pickle spears into a cylindrical transparent container or jar with the spears positioned side-by-side adjacent each other around the interior periphery of the jer, with the corresponding cut faces of the spears facing outwardly, and to do so in a quick, simple and reliable manner.

SUMMARY OF THE INVENTION

According to the present invention, there is provided a method and apparatus for the orderly packing of elongated food products in a container of predetermined cross-sectional dimensions, in which food products are supported substantially parallel to each other on a substantially flat flexible carrier belt, and the belt is rolled up with said food products thereon so that the food products within the belt assume the cylindrical configuration and the individual orientations which are to be provided for them in the container, after which the array of food products is slid from the rolled-up carrier belt into the container while maintaining the desired positions and orientations of the food products in the array.

In a preferred embodiment, the food product is cut pickle spears, the container is a transparent, substantially right-cylindrical jar, and the rolled-up belt is also in the form of a right cylinder with a circumference substantialy matching that of the interior of the container, so that the spears occupy substantially the complete periphery of the interior of the container when packed therein. In a preferred embodiment, a center mandrel is provided around which the belt and the food products thereon are rolled up, and from which the array of food products is slid during the packing operation. Preferably, means are provided for advancing the belt carrying the food products while the leading edge of the belt is guided through a path which is cylindrical about the axis of the mandrel. Although it is possible to move the belt in response to rotation of a central axle about the mandrel axis while advancing the belt at just the right rate to move the belt along a cylindrical path, it is possible to drive the belt with the chain-drive type of apparatus described hereinafter, in which the front end of the flexible belt is secured to a freely rotatable central axle by a radially extending vane or the like, and the drive for the rolling-up of the belt is provided by driving a flat section of the belt to force the leading end of the belt along the selected curved path, while permitting the vane and axle member to turn freely in response to this driving action. Preferably, guides are provided for the outer curved surface of the belt as it advances, and for the inner curved surface of the belt as it is retracting.

In a presently preferred form of method and apparatus for accomplishing the roll-up and unrolling of the belt or band, the guide means comprises a pair of parallel guides extending along opposite sides of the band, the forward ends of the guide means curving upward into a cylindrical configuration; the wrap-up band is provided with a plurality of guide-contacting means in the form of strips secured to the band at intervals along its length, the ends of which are adapted to ride slidingly along the guide means.

In a preferred embodiment a front stop member is provided, which may be the above-mentioned vane, and a rear stop member is spaced backwardly along the carrier belt, the distance along the belt between the two stop members being substantially equal to the circumference of the container in which the food products are to be packed, so that so long as the space between these two stops is filled with pickles when the belt is rolled into a cylinder, the periphery of the jar will be substantially solidly packed with the food product regardless of the number of food articles required to fill the space between the stops. To achieve the desired close packing of the food products in the rolled-up belt, the food products are preferably loaded onto the flat belt close together, with the leading food product against the front stop and the last or trailing food product spaced by a predetermined distance from the rear stop member.

In a preferred embodiment, a plunger is provided which fits closely within the cylindrical rolled-up belt and around the central axle or mandrel and, when the plunger and mandrel are advanced, slides the annular array of food products from the belt through the mouth of the container and into position against the outer walls thereof.

In the case of pickles, the spears are preferably loaded onto the carrier belt with a particular one of their cut faces downward, and preferably with the outer skin surface facing rearwardly, opposite to the direction of advance of the belt. The apparatus described will roll the spears into a cylindrical array in which each pickle spear presents the same cut face outwardly, this position being maintained during the packing into the jar, as is desirable for the reasons mentioned above. Any opening left in the center of the annular array is preferably packed with additional pickle spears, either manually or automatically.

After discharge of the array of food products from the rolled-up belt into the container, the belt is moved in the opposite or retracting direction until it resumes its original flat configuration for the reception of another group of food products.

In one preferred form of the apparatus, the elongated food products are loaded onto the reciprocable flexible belt from a stacking belt on which they are previously placed, by means of a reciprocable pusher which pushes an entire group of food products into position between the above-described front and rear stops on the flexible belt. The stacking belt is preferably provided with a front stop or fence extending across it for arresting the progression of pickles on the belt, so the pickles may be loaded onto the latter belt at an upstream position in a spaced-apart arrangement but will be arrested by the above-mentioned fence and caused to stack up and assume contiguous positions as desired, until the desired length of the array of contiguous food products is achieved, at which time the above-mentioned pusher arrangement is actuated to transfer the horizontal stack of spears onto the flat flexible plate adjacent thereto.

Also, in a preferred embodiment the roll-up belt is provided with means projecting below it near its forward end, which when the belt is nearly completely rolled up will contact the rear side of the last spear on the flat portion of the belt adjacent the rear stop if that spear is not properly positioned flat against the belt in front of the rear stop, and urge it into the latter position as the belt completes its rolling-up cycle.

BRIEF DESCRIPTION OF FIGURES

These and other objects and features of the invention will be more readily understood from the following detailed description of representative embodiments thereof, taken with the accompanying drawings, in which.

DETAILED DESCRIPTION OF SPECIFIC EMBODIMENTS

Figure 11:
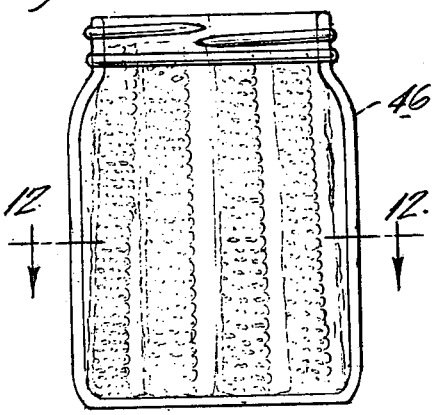
FIGS. 11 and 12 are enlarged side and sectional views respectively of the packed container.
Figure 12:
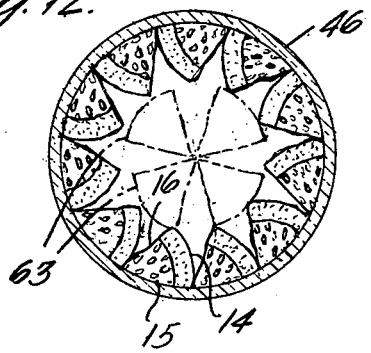

Referring now to the specific embodiments of the invention shown in the accompanying drawings, which are presented by way of definiteness only and not as limiting the scope of the invention, FIGS. 1 to 10 show the apparatus schematically in successive steps of the process, as applied to the packing of pickle spears into a jar; FIGS. 11 and 12 illustrate how the pickle spears are located in a jar as a result of practice of the invention; and FIGS. 13 to 26 are mechanical views showing more details of a preferred mechanical construction of apparatus suitable for use in practicing the invention in this form.

Figure 1:
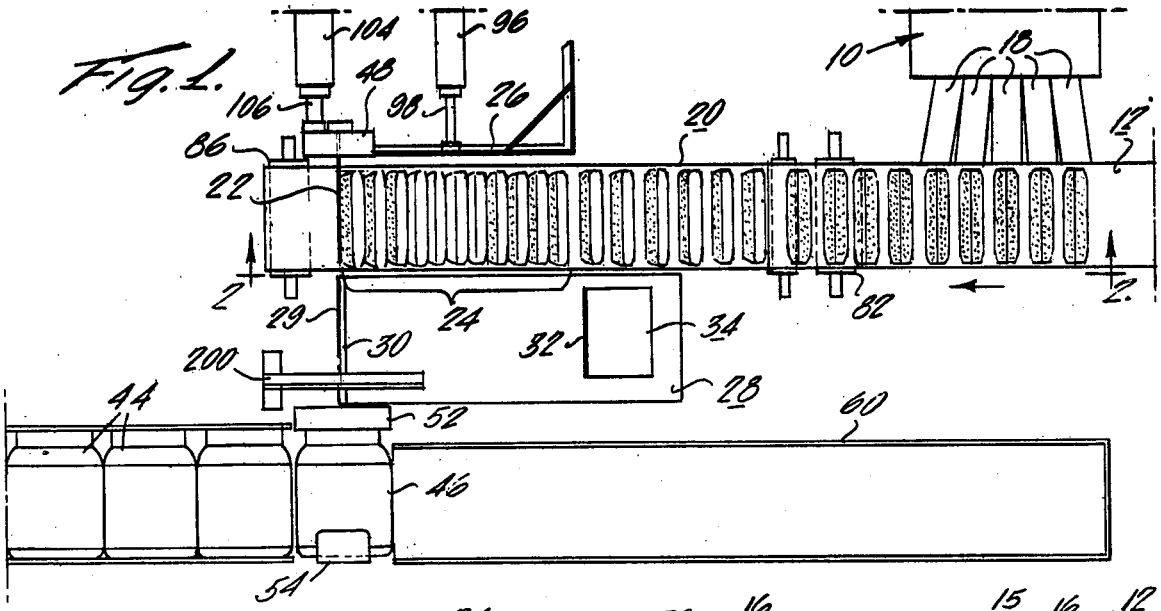
FIG. 1 is a schematic plan view of a system embodying features of the invention, in the condition in which a horizontal stack of cut pickle spears has been accumulated on the stacking belt, ready for delivery to the roll-up belt.

Thus FIG. 1 shows schematically a pickle spear dispenser 10 which dispenses pickle spears side-by-side upon a first endless conveying belt 12. The pickle spears are assumed to have been cut lengthwise into five similar segments each having a skin-covered side 14 (FIG. 2) which rests on the belt 12, and two cut or seed faces such as 15 and 16 which give the spears substantially triangular cross-sectional forms.

The nature of the spear dispenser 10 is not a part of the present invention, and hence need not be described in detail. It is understood that it includes, or is preceded by, a station at which the pickles are cut to predetermined lengths by any appropriate cutting or guillotining procedure, so they will fit lengthwise into the jar into which they are to be packed. In this example it is assumed that the spears are dispensed by way of five separate corresponding chutes 18, each time the conveyor belt 12 has moved to the left sufficiently to leave an open space for receiving five newly-dispensed spears. The spears may, if desired, in some cases be laid on conveying belt 12 manually.

Figure 2:
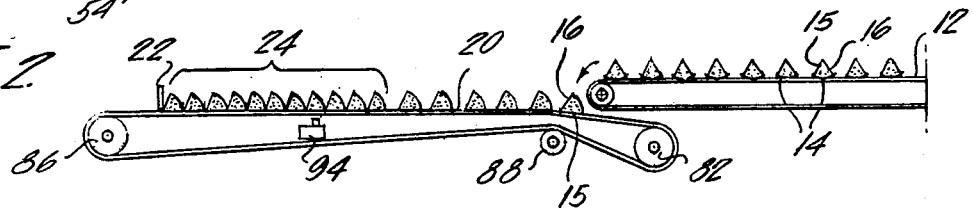
FIG. 2 is a schematic sectional view along the lines 2—2 of FIG. 1.
Figure 3:
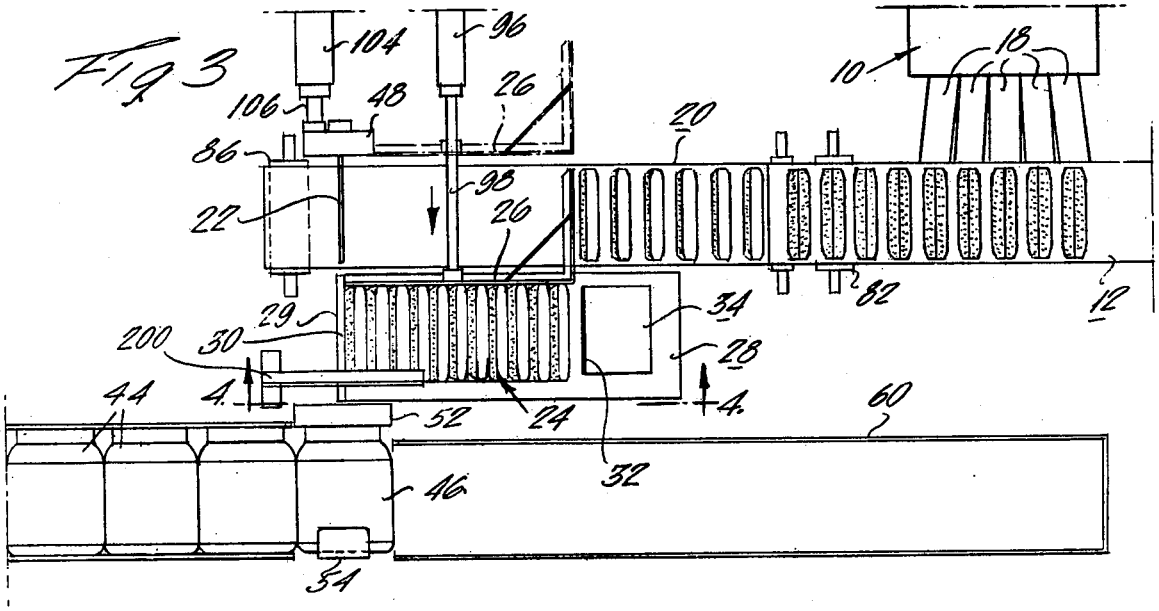
FIG. 3 is a schematic plan view like that of FIG. 1 showing the horizontal stack of cut pickle spears delivered onto the roll-up belt.

The top run of belt 12 travels to the left in FIG. 1, and serves as a reorienting belt for turning each of the pickle spears onto the same corresponding cut side, as shown most clearly in FIG. 2. To accomplish this, a second endless conveyor belt 20 downstream from belt 12, with its upstream end positioned extends below the downstream end of the first conveyor belt; the speed of the first conveyor belt 12 is adjusted so that as each spear reaches the downstream end of belt 12, it topples forwardly onto belt 20, and what had previously been its left-hand cut side becomes its "down" side, positioned against the top of belt 20. Belt 20 is preferably driven slightly faster than belt 12, so as to assure that the last-toppled spear has moved out of the way before the next successive spear falls from belt 12 onto belt 20.

A fence 22 is provided near the downstream end of the top of belt 20, extending across the lateral dimension of belt 20 with its lower end just above top surface of the belt. As shown in FIGS. 1 and 2, fence 22 stops the forward progress of the spears, so that they remain fixed in position and the belt 20 slides beneath them. As a result, the previously spaced-apart spears back up behind fence 22, forming a horizontal group or stack 24 of contiguous spears. This is the group of spears which will be packed into the pickle jar in the cycle of operations now to be described. In this case the group consists of eleven spears, by way of example; if the individual spears are somewhat larger or smaller in cross-sectional size, correspondingly fewer or more spears will be present so as to present approximately the same overall length for the group of backed-up spears.

When the length of the backed-up group of spears equals that desired to be packed closely around the interior periphery of the pickle jar, first and second conveyor belts 12 and 20 are stopped so that the upstream spears hold the positions shown in FIGS. 1 and 2. A pusher bar 26 is then advanced to slide the backed-up group of spears 24 laterally onto a roll-up belt 28. Once the pusher bar 26 has accomplished transfer of the group of spears 24 onto the roll-up belt, it is retracted to its original position.

Roll-up belt 28 is of a flexible resilient material, such as a band of stainless steel, and is provided at its leading end with a right-angle portion 29, preferably formed by bending the front or leading end of the roll-up belt sufficiently to deform it into a permanent right-angle configuration; portion 29 is secured flat against a vane 30 extending radially from mandrel 36. Also provided on the belt 28 is a rear stop 32, in this case consisting of the vertical front flange of a bracket 34 secured to the top of belt 28. Stop 32 is spaced somewhat rearwardly of the last of the spears on the belt 28. The rear stop 32 prevents the group of pickle spears from sliding any further rearwardly than its confronting vertical face as the spears are subsequently rolled up into a compact cylindrical array inside the roll-up belt 28.

Figure 4:
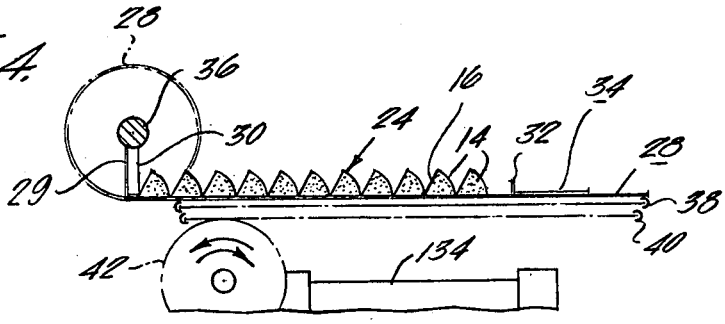
FIG. 4 is a schematic sectional view taken along the lines 4—4 of FIG. 3.

As stated, the vane 30 at the front end of the roll-up belt is secured to a rotatable mandrel 36 at its outer free end (see FIG. 4). The axis of mandrel 36 extends horizontally and at right angles to the longitudinal axis of the roll-up belt 28, and is positioned directly above the forward end of the flat portion of the latter belt, so that in the condition shown in FIG. 4 vane 30 extends vertically upward to the mandrel. The flat portion of roll-up belt 28 initially lies flat on an appropriate flat supporting surface along which it can slide. In this example mandrel 36 is mounted as an idler, rather than a driving axle, and the vane 30 serves not only as a forward stop for the group of pickle spears on the roll-up belt, but also as a guide for the front of the flat portion of the belt to assist in guiding it along a cylindrical path, as represented by the circle shown in broken line in FIG. 4, during the roll-up procedure.

As will be described in more detail with respect to subsequent figures, roll-up belt 28 is provided on its undersurface with two runs 38 and 40 of interconnected roller chain links and driven longitudinally by means of a bi-directionally rotatable sprocket wheel 42, which meshes with successive links of the lower run of chain. Operation of sprocket wheel 42 in the counterclockwise direction causes the flat portion of roll-up belt 28 to advance to the left, with its front end guided into a cylindrical path, and rotation in the clockwise direction causes the belt to unwind from its rolled-up position and reassume its flat condition for receiving subsequent groups of spears. Details of the chain drive arrangement and of suitable additional guiding means for the roll-up belt as it moves through its cylindrical path are shown in subsequent figures.

Figure 5:
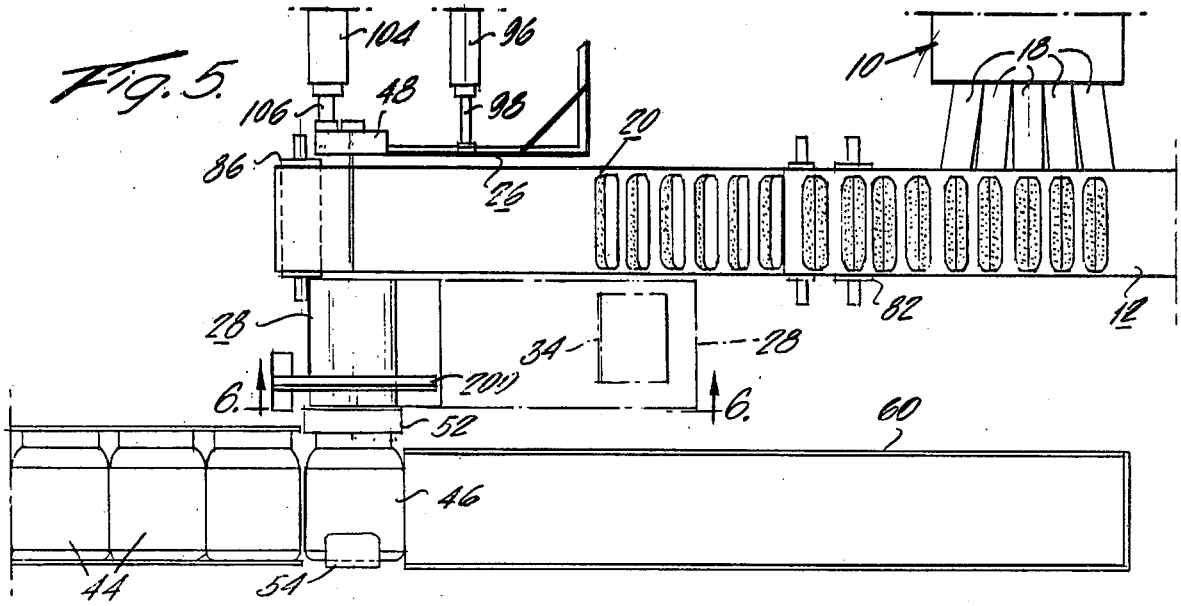
FIG. 5 is a schematic plan view like that of FIG. 1, in which the roll-up belt is fully rolled up with the pickle spears inside it.
Figure 6:
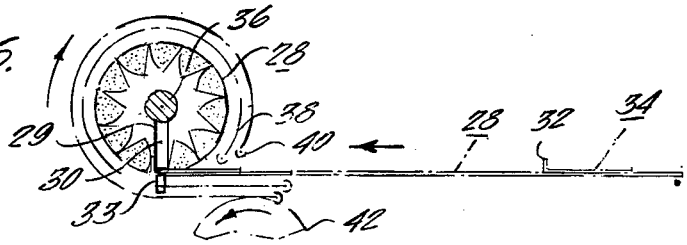
FIG. 6 is a schematic sectional view taken along lines 6—6 of FIG. 5, showing especially the pickle spears rolled up in the belt.

FIG. 5 illustrates in full-line the condition of the apparatus when the roll-up belt 28 has been completely rolled up, to produce the cylindrical array of closely-packed spears illustrated in FIG. 6. The spears in this configuration are ready to be pushed into the pickle jar simultaneously, as a group. As will be described more fully with reference to FIGS. 16 and 18*a*, a pair of protruding pins such as 43 is provided at the front end of the lower side of belt 28 to urge an occasional recalcitrant last spear into proper position on the belt in front of the rear stop member 32.

Figure 7:
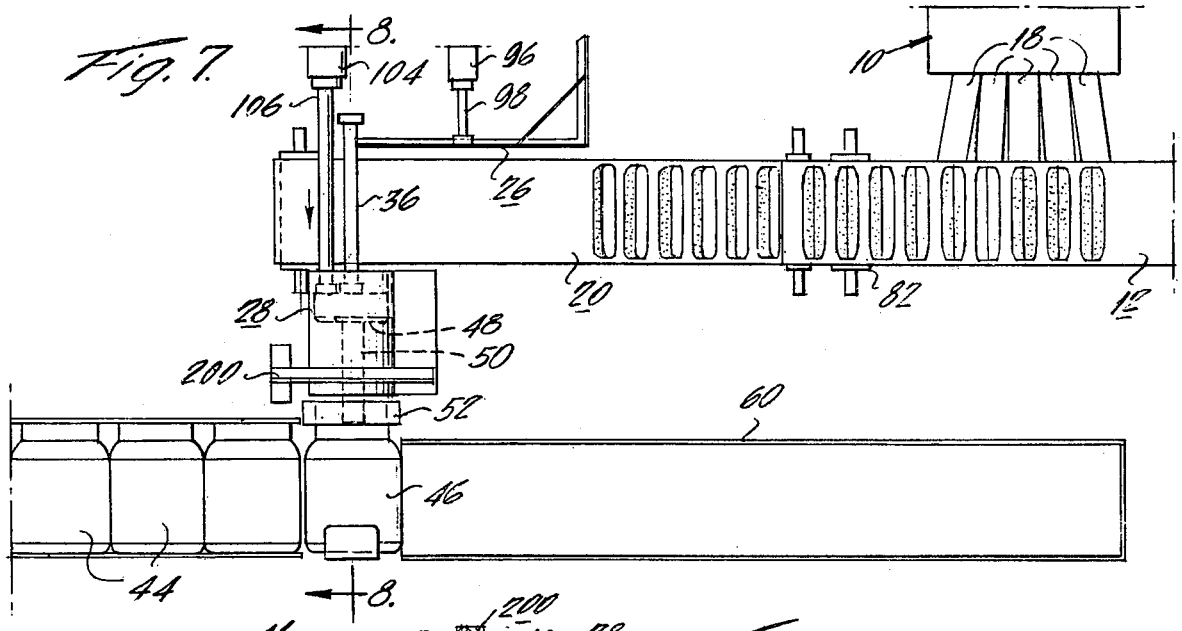
FIG. 7 is a schematic plan view like that of FIG. 1, showing the pusher cylindes advanced to begin pushing of the spears into the mouth of the container.

As further shown in these schematic figures, a train of jars 44 is provided so that, at successive times, each jar occupies the spear-receiving position shown for front jar 46 in FIG. 7. At the time when loading or packing of the spears into the front jar is to be accomplished, the jar is positioned horizontally as shown, with its open mouth coaxially positioned with respect to the axis of the mandrel 36 in the rolled-up belt. At this time a cylindrical pusher 48 (FIGS. 5 and 8) is advanced into the end of the rolled-up belt opposite from the jar, so as to push against all of the spears in the cylindrical array of spears and to slide them out of the belt and into the jar. Pusher 48 is preferably mounted to, or integral with, a mandrel sheath 50 (see FIG. 16) adapted to slide over the outside of mandrel 36 and to fit within the open center formed by the cylindrical array of spears.

Figure 8:
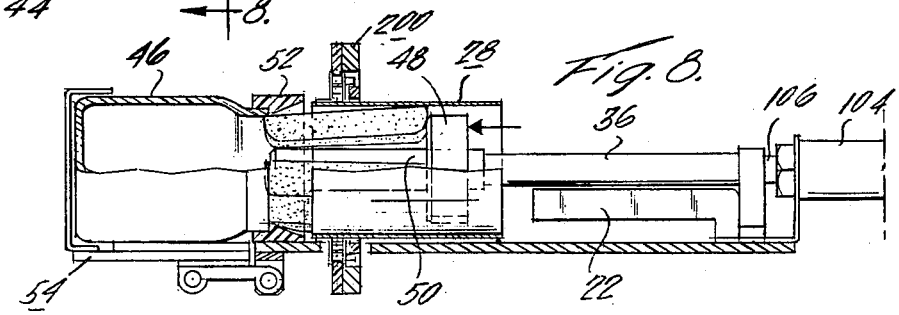
FIG. 8 is a schematic sectional view taken along lines 8—8 of FIG. 7.
Figure 16:
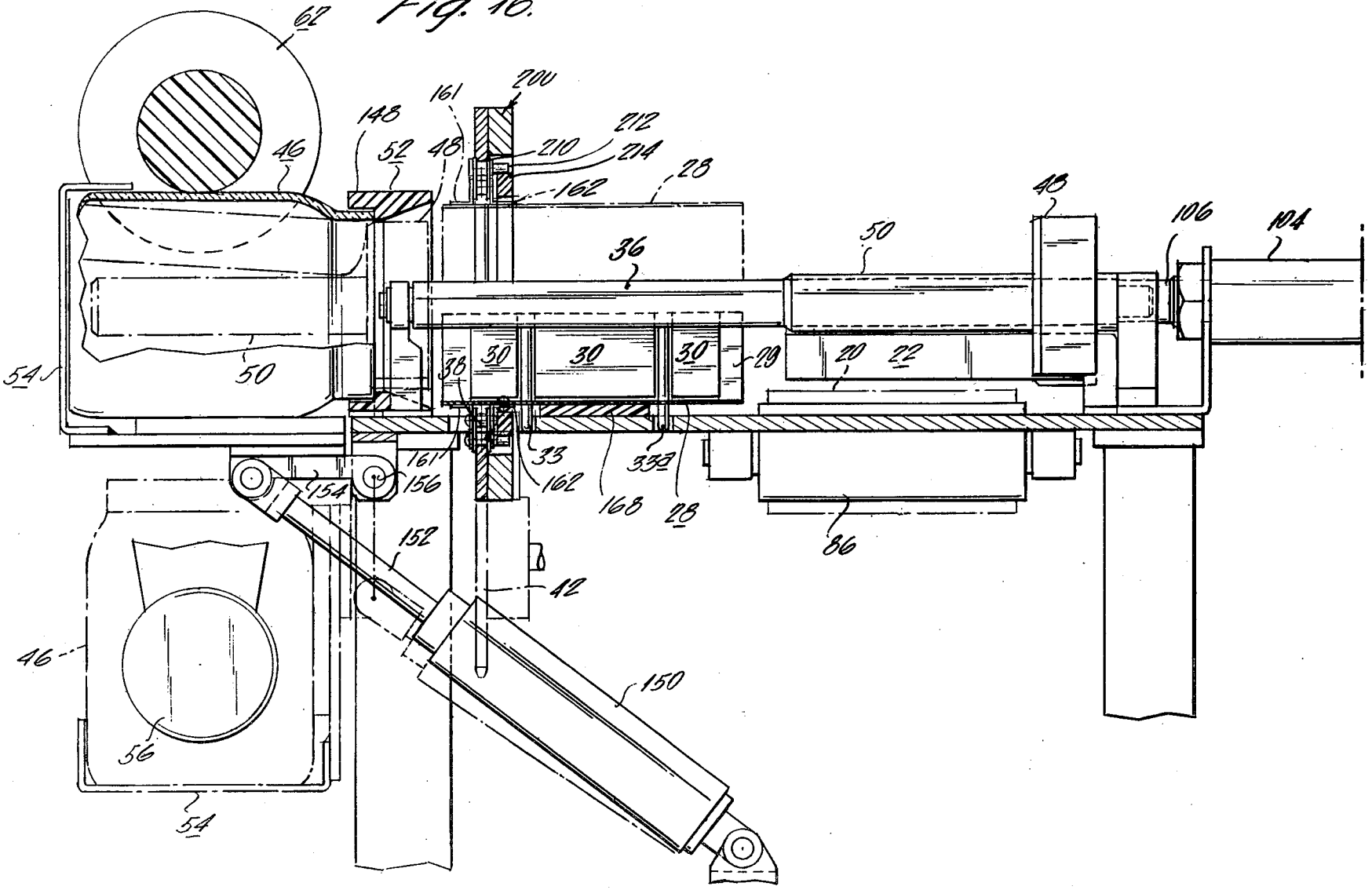

FIGS. 8 and 16 show conditions as they exist at the time when the spears are first entering the jar 46. Preferably a funnel ring 52 is provided between the exit end of the rolled-up belt and the mouth of the jar 46, causing the leading end of the rolled-up spears to be guided radially inwardly as they approach the mouth of the jar, which is of slightly lesser diameter than the interior of the rolled-up belt and of the interior of the jar. Thus the pusher 48 forces the spears through the mouth of the jar into the interior thereof, where they assume the position shown in FIG. 11. During the time when the spears are being loaded into the jar, the mandrel sheath 50 extends into the jar, to a position near the bottom thereof as shown in FIG. 16, to assure that the packed spears are properly positioned around the interior periphery of the jar, with the center clear.

Figure 9:
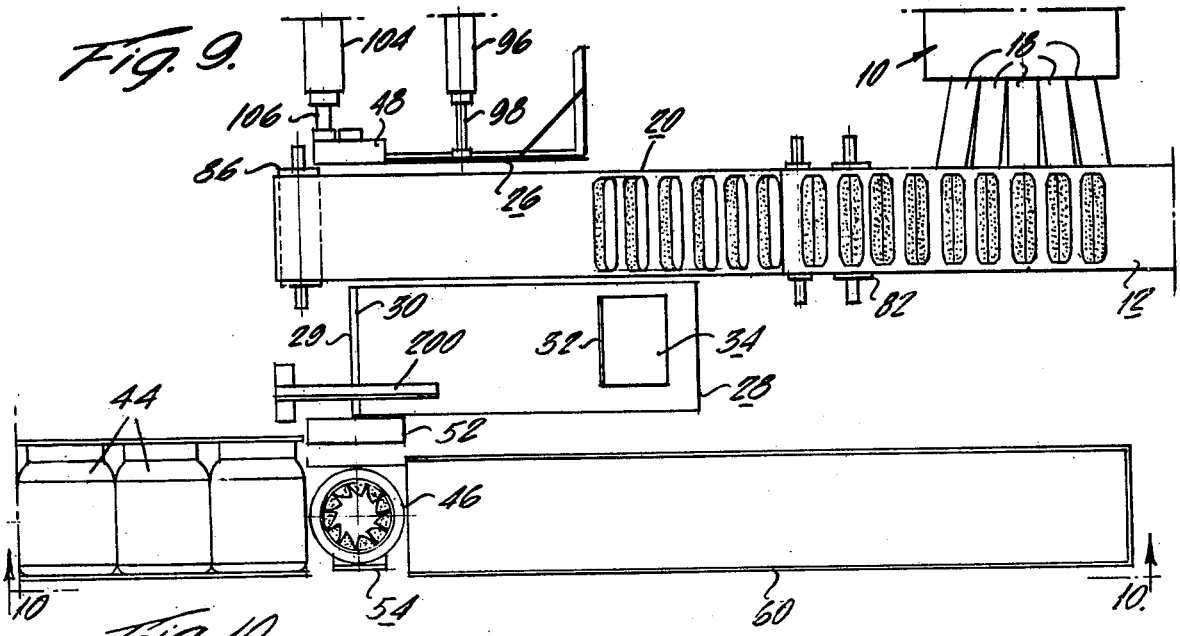
FIG. 9 is a schematic plan view like that of FIG. 1, showing the container packed with the spears and turned upright.
Figure 10:
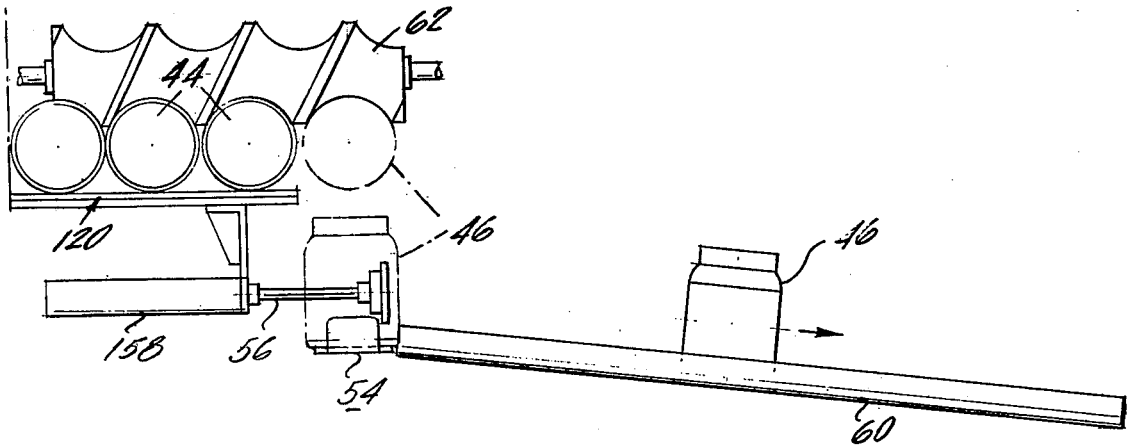
FIG. 10 is a schematic side view taken along lines 10—10 of FIG. 9, showing the packed container discharged from its loading position onto a discharge chute.

As shown in FIG. 9, after the cylindrical pusher 48 and mandrel sheath 50 are retracted from the jar 46, the packed jar may be automatically turned to a vertical position lower than the train of empty arriving jars by means of a pivoting platform 54, and discharged from the platform 54 by means of a reciprocating plunger 56 to slide down a discharge chute 60, as illustrated in FIG. 10. FIG. 10 also shows a screw conveyor 62 which is preferably used to control the advance of the jars into the loading position.

FIGS. 11 and 12 show the jar packed with the peripheral cylindrical array of spears, all with the corresponding cut sides facing outwardly against the interior of the jar. Also shown are additional spears such as 63, which may be manually or automatically packed into the central opening in the annular array of spears subsequent to the above described loading of the cylindrical array of spears into the jar. The jar containing the pickle spears is then ready for filling with brine and capping with a vacuum-tight screw lid.

Figure 13:
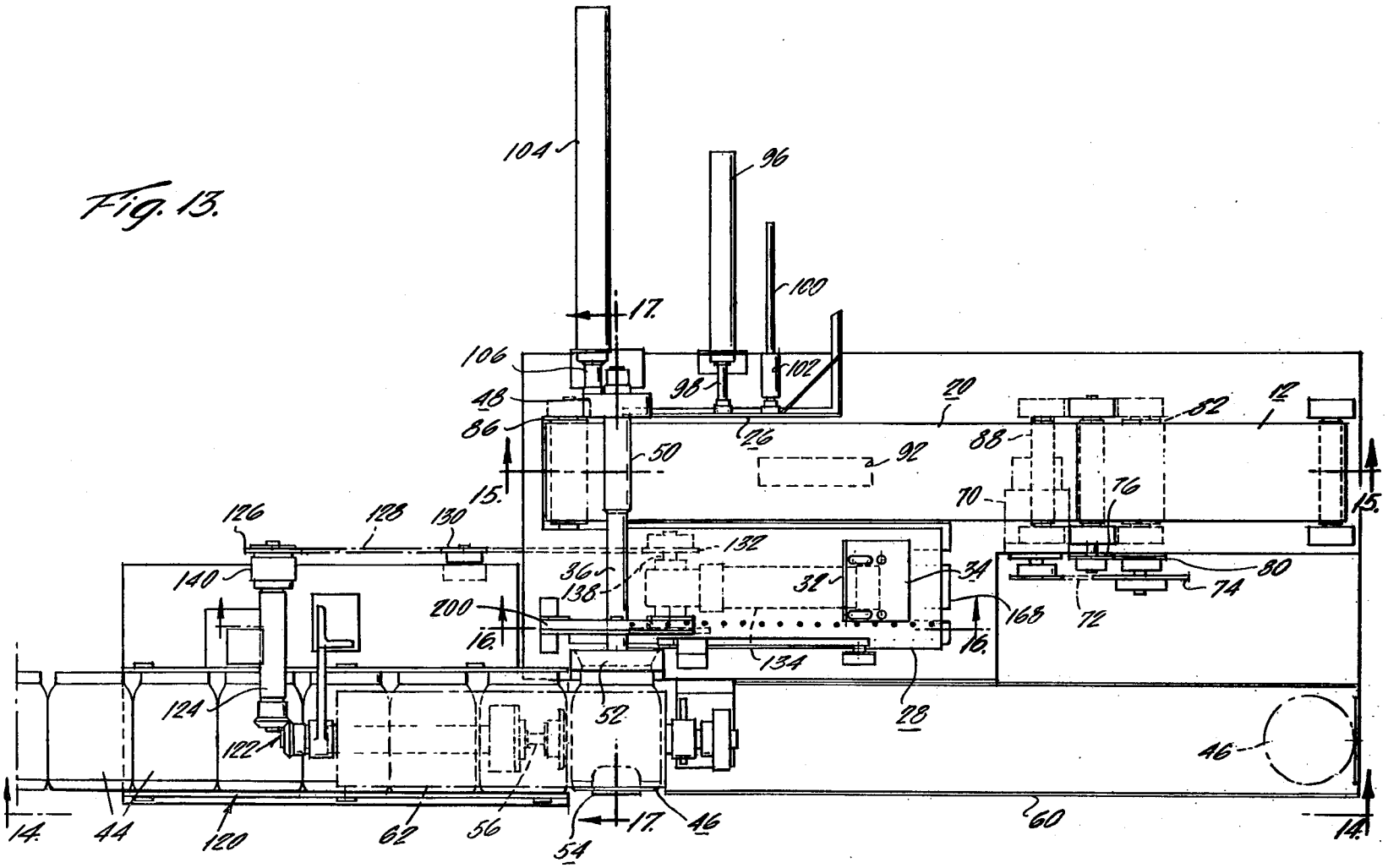
FIG. 13 is a plan view of the apparatus showing in more detail one construction thereof.
Figures 14, 15:
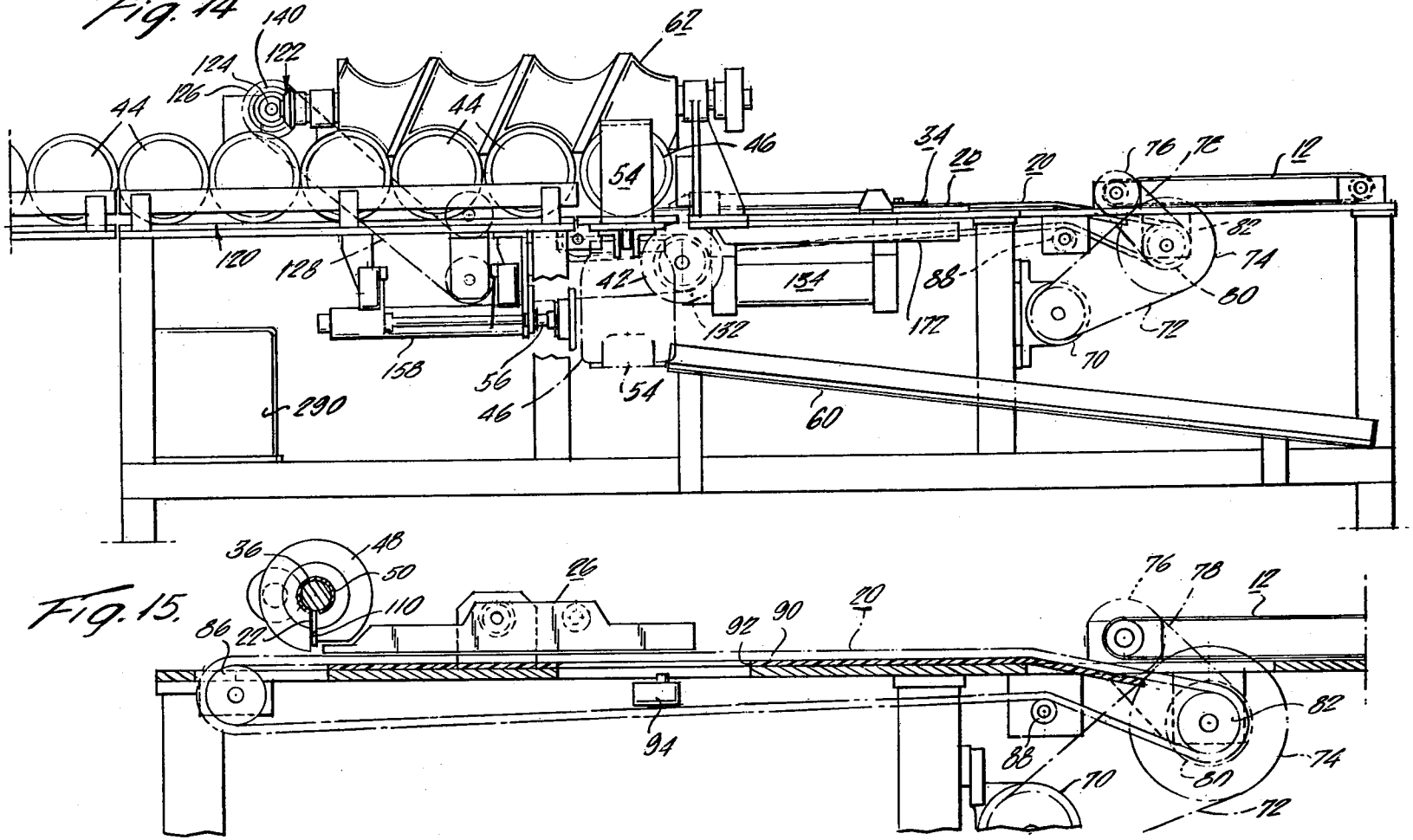
FIGS. 14 to 17 are enlarged sectional views taken along lines 14—14, 15—15, 16—16 and 17—17 respectively in FIG. 13, showing further details of this construction.

Turning now to the more detailed drawings of FIGS. 13 to 14, showing preferred constructions of various of the elements of the system shown schematically in the preceeding figures, in this specific embodiment a motor 70 drives a chain 72, which in turn drives main sprocket wheel 74 (see FIGS. 14 and 15). First conveyor belt 12 is driven by rotation of sprocket wheel 76, which in turn is driven by a chain 78; the latter chain is driven by sprocket wheel 80 which rotates with sprocket wheel 74. The upstream end of conveyor belt 12 may pass around a conventional idler pulley.

The second conveyor belt 20 is driven from drive roll 82 which turns with sprocket sheel 74 and is preferably of somewhat larger diameter than sprocket wheel 80, so that the second conveyor belt moves somewhat faster than the first conveyor belt 12, for reasons explained previously herein. Second conveyor belt 20 is in the form of an endless loop, extending around pulley 86 at its upstream end and tensioned by means of tensioning pulley 88.

Second conveyor belt 70 in this example is made of a porous mesh metal material which will readily pass an air stream, and slides over a belt support surface 90 having an opening 92 therein through which a pneumatic sensor 94 directs an upward flow of air, which also passes through the mesh belt. The mesh belt may be a commercially available belt such as the 4⅛" wide model B48-48-17 stainless steel belt made by Cambridge Metal Belts Co. Pneumatic sensor 94 and associated sensing equipment (not shown) may be of a commercially available type which maintains a predetermined pattern of air flow above it when no pickle spear is blocking the flow of air, but when the latter flow is blocked for a predetermined period of time by the presence of a pickle spear above it on the conveyor belt, it provides a pneumatic signal indicative of this condition. The pneumatic system is adjusted in this instance so that, when the pickle spears are passing above it with normal spacing between them, they do not interrupt the air flow sufficiently long to produce a signal indication from the sensor; however, when the pickle spears have backed up sufficiently that they extend over the pneumatic sensor, the air flow from the sensor is blocked long enough to produce a signal indicative of this condition. This signal, in this example, is used to stop motor 70 and hence the first and second conveyor belts.

Since, utilizing such apparatus, there is typically an appreciable lag or delay between the time when the sensor produces a signal and the time when the conveyor belts actually stop, the sensor will generally be placed somewhat downstream from the position at which it is desired to have the upstream end of the backed-up stack terminate; in this example, it is assumed that the delay is such that three additional pickle spears are added to the backed-up stack by continued motion of the conveyor belts after the sensor signal has been produced. In general, it will be desirable to mount the sensor so that it can be adjusted in position longitudinally of the mesh conveyor belt, to determine experimentally the best location for it in order to produce the desired length of the backed-up stack of spears.

The pusher bar 26 in this example is connected to a pneumatic cylinder arrangement 96 (FIG. 13) for controlledly moving piston 98 thereof forward and backward as desired to advance or retract the pusher bar; a guide rod 100 extending through fixed sleeve 102 is provided to assist in maintaining alignment of the pusher bar during its reciprocation.

The pusher cylinder 49 which pushes the spears out of the rolled-up belt, and the integral mandrel sheath 50 secured thereto and riding over the exterior of mandrel 36, are controlled by a pneumatic piston arrangement 104, the piston 106 of which is secured to pusher cylinder 48 at its exterior side. To permit advancing of the pusher cylinder and mandrel sheath despite the presence of vane 30 in the rolled-up belt, both the pusher cylinder and the mandrel sheath are provided with a vertically-extending radial slot 110 (FIG. 15) of a size and position to receive vane 30 within it, without binding, when the pusher cylinder and sheath mandrel are advanced and the vane 30 is in its vertical position at the end of full roll-up of the belt, the condition represented in FIGS. 5 to 8, for example.

The advancing of the jars 44 along their track 120 is provided by rolling them in response to rotation of the screw conveyor 62. The rotation of the screw conveyor is synchronized with the system operation by driving its shaft with a bevel gear arrangement 122 (FIG. 13) and a transverse drive shaft 124; the latter shaft is driven, through sprocket 126, by a chain 128 which passes under an idler sprocket 130 and a drive sprocket 132. The latter drive sprocket 132 is operated by pneumatic motor arrangement 134 to provide reciprocating motion of a piston which in turn produces rotation of shaft 138 through a predetermined angle first in one direction and then in the opposite direction. A clutch arrangement 140 is provided so that the shaft of screw conveyor 62 responds to only one sense of rotation of shaft 138, namely the direction which causes the train of jars to advance. The drive arrangement is such that each successive interval of drive of the screw conveyor is just sufficient to advance the jar train by one jar position and thus assure that a jar is in the receiving position shown in FIG. 13 each time the pusher slides an array of pickles out of the rolled-up belt 28.

FIG. 16 illustrates an arrangement by which the filled jar 46 is pivoted vertically and discharged onto chute 60. After being advanced against a positioning stop 148 and into a U-shaped platform 54, it remains in this position until it has been filled with the pickle spears, at which time pneumatic cylinder arrangement 150 retracts piston 152. Through pivoted linkage 154, this causes the positioning holder and platform to be rotated about axis 156 to the vertical position shown in broken line in FIG. 16, after which pneumatic cylinder arrangement 158 (FIG. 14) is actuated to advance plunger 56 against jar 46 and discharge it onto chute 60; pneumatic cylinder arrangement 150 is then returned to its original state to permit advance of the next-succeeding jar into the positioning holder 148, ready to receive the next group of pickles the next time the belt 28 is rolled up.

Figures 17, 18A, 18B, 19:
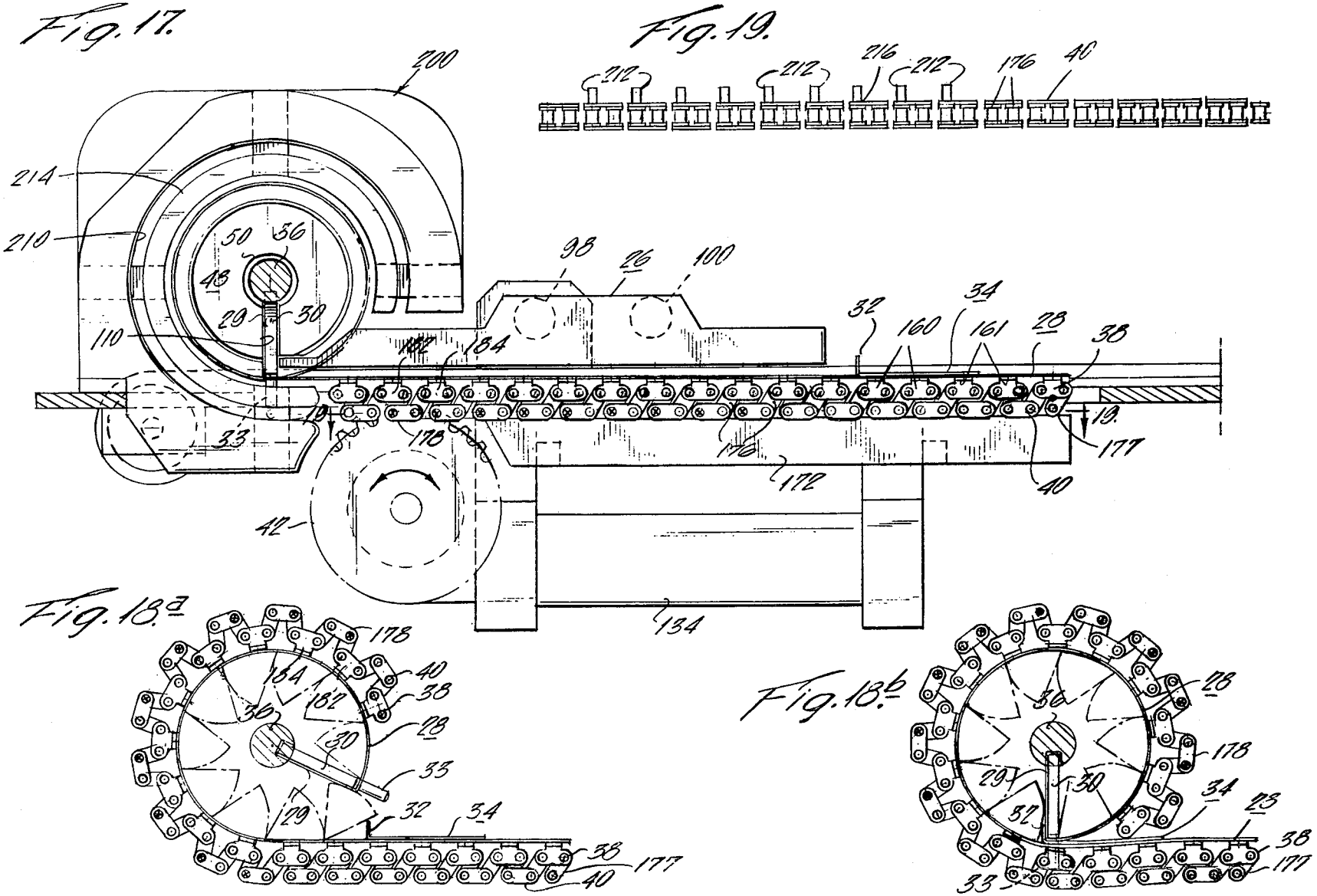
FIG. 18*a* is a side elevational view of the belt and drive chain with the belt in its partially rolled-up condition.
FIG. 18*b* is a similar view with the belt fully rolled up.
FIG. 19 shows the lower run of chain as viewed along lines 19—19 of FIG. 17.

FIGS. 17 to 19 illustrate details of the chain drive system used to roll up and unroll the roll-up belt 28. In this arrangement, alternate links such as 160 of a single continuous roller chain are provided with pairs of right-angle mounting brackets such as 161 and 162 on each side thereof (see FIG. 16), each of which brackets has a foot 162 which is riveted to belt 28 at the side thereof, so as to provide the previously-mentioned upper run of chain links 38 secured to the underside of the roll-up belt. The remainder of the roll-up belt is slidingly supported on a plastic table 168. Intermediate links, such as 170, of the roller chain, are connected between the alternate links of the upper run and positioned adjacent each other beneath the riveted links to form the lower run 40. A major portion of the length of the lower run rides on rail 172. The linkages arms such as 176 which join the links of the upper run to those of the lower run are slanted forwardly from the upper run toward the lower run, as shown, but are capable of pivoting with respect to the upper run of links, when free to do so. Preferably, the last or rearmost linkage arm 177 is welded to its riveted link to prevent it from rotating, so that this link is held in the forwardly-slanted position shown, to assure that the linkage arms remain slanted forwardly for both directions of drive of the chain.

Positioned below and near the front end of the flat portion of the roll-up belt in its retracted flat position is sprocket wheel 42, the peripheral teeth of which mesh with the successive links of the lower run of chain. As stated previously, sprocket 42 is rotated by pneumatic motor 134 first counterclockwise to drive the lower run of chain 40 in the direction to wind up the belt 28 into a cylindrical form, and then clockwise to unwind the belt and return it to the flat position shown in FIG. 17.

More particularly, sprocket wheel 42 as shown in FIG. 17 initially meshes with the link which is the second from the front end of the lower run of chain, that is, initially link 178 is the driven link. It will be seen that as the driven link is urged forwardly, i.e., to the left in FIG. 17, its two linkage arms pull the adjacent riveted chain links 182 and 184 forwardly, thus distributing the driving force substantially equally between them and between the parts of the roll-up belt to which they are secured.

A chain guide assembly 200 is provided concentric with roll-up mandrel 36 to assure that belt 28 will be reliably rolled into an exact cylinder, and will be unwound along the same path over which it was rolled up. To this end, the chain guide assembly includes a circular track 210 concentric with mandrel 36 and positioned so that the lower run of chain links 40 rides over track 210 during the roll-up procedure.

FIG. 18*a* illustrates the double-run of chain in the partially rolled-up condition, wherein it can be seen that the outer run of chain, which is the lower run of chain in the flat condition of the chain, has its linkage arms spread farther apart than in the flat condition, which is necessary since the links of the outer run of chain are radially further outward than the links of the inner run of chain, when rolled up. This spreading apart of the outer links is made possible by the pivoting of the linkages joining them to the links of the inner run of chain.

To assure return of the chain along the same cylindrical path during unrolling, and thus assure that the chain links will mesh properly with the sprocket wheel 42 during unrolling of the belt 28, guide means are also preferably provided to be operative during the unrolling step. The unrolling guide means comprise guide pins such as 212 (FIGS. 16 and 19) extending horizontally outwardly from certain of the links of the lower run of chain, so that during unrolling they will bear against the outer side of the cylindrical inner guide track 214 and thus be constrained to follow the desired cylindrical path.

The positioning of the vane at right angles to the adjacent portion of the roll-up belt is strengthened by including as parts thereof the pins 33, 33A, which are screwed at one end into the mandrel 36 and extend radially, along the vane and through the roll-up belt, to protrude from the underside thereof. A corresponding pair of slots 213 (FIG. 13) are provided near the opposite end of the roll-up belt, through which the protruding ends of the pins extend as the belt is completely rolled up. As described previously, the protruding ends of the pins assist in pulling in and seating properly the last spear, if it tends to be tilted upward against the rear stop 32 as shown in FIG. 18*a*. In this connection it will be understood that as the spears are wound up in the belt 28, the spears normally spread farther backward along the belt toward the rear stop 32, because the portions of the spears positioned radially inward from the rolled-up belt are forced to lie along a circular arc of a length smaller than the corresponding length of the rolled-up belt. The space which is provided between the last spear and the rear stop on the flat belt prior to roll-up is provided to accommodate this back-up of the spears along the belt during roll-up. However, due to pressure between the last spear and the rear stop the last spear may become cocked against the stop member by the time the belt is nearly rolled-up as shown in FIG. 18*a*, and it is such spears that the protruding pins are designed to contact and push into position ahead of the stop.

FIG. 19 shows one convenient way in which the guide pins 212 may be provided on the chain links of the lower chain run. One of the usual transverse chain-link pins in each link is replaced by the guide pins 212, the shoulder 216 on each guide pin serving to hold the link together at one side, the opposite end of the guide pin being riveted as usual to complete the assembly.

It is possible to practice some embodiments of the invention by hand actuation. For example, pickle spears may be placed on the flat roll-up belt, a hand-crank operated to roll up the belt and pickle spears, and the rolled-up spears pushed by a hand-operated plunger into a hand-held jar. It is also possible to operate it in a semi-automatic manner by providing a control panel with appropriate push-buttons for controlling the starting and stopping of the conveyors, the advancing and retracting of the pusher bar, the initiation of roll-up and unrolling of the roll-up belt, the advancing of containers into the product-receiving position, the pushing of the product from the rolled-up belt into the receiving containers, and the discharge of the packed containers from the product-receiving position. However, in the embodiments believed to have the most important applications, all of these steps are preferably automatic.

Thus it will be understood that appropriate timing-control and sequencing means are preferably employed in the specific embodiments described, which automatically provide the sequence of operations set forth above. While the timing-control system may comprise conventional electronic sensors, limit switches, solenoids and/or photo-electric devices, it is preferred to use pneumatic devices for these purposes. Thus in one embodiment a pneumatic sensor is used to sense the accumulation of the group of backed-up contiguous spears to be packed, and to produce the signal for stopping the conveyor drive motor and starting the pusher-bar cycle of advance and retraction; the beginning of retraction of the pusher bar from its furthest-advanced position is pneumatically sensed to initiate the rolling-up of the belt with the spears on it; the advance-retract cycle of the pusher cylinder for discharging the spears from the rolled-up belt into the container is also initiated by a pneumatic sensor; the return of the roll-up belt 28 to its flat unrolled state is pneumatically sensed to restart the conveyor belt; the timing of the container-advance and discharge cycle is controlled, as described above, by mechanical linkage to the roll-up belt drive. Since suitable devices for performing these or other suitable timing-control functions are well-known in the art, they have not been shown in detail in the drawings in the interest of clarity. It is understood that they may be contained in a control box 290 (FIG. 14), except for the sensors which are located at the appropriate points in the system and connected to the control box by suitable pneumatic hoses.

Figure 20:
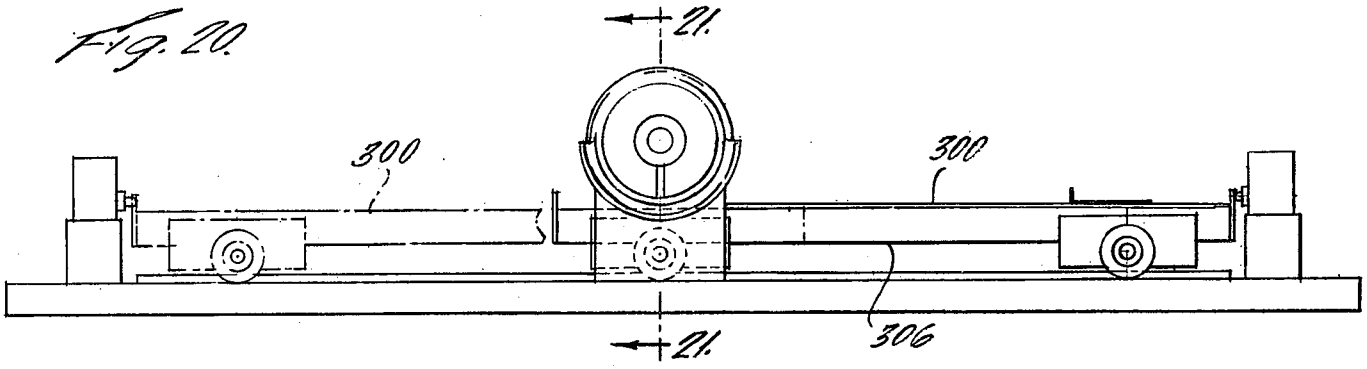
FIG. 20 is a side view of another simpler version of apparatus embodying the invention.
Figure 21:
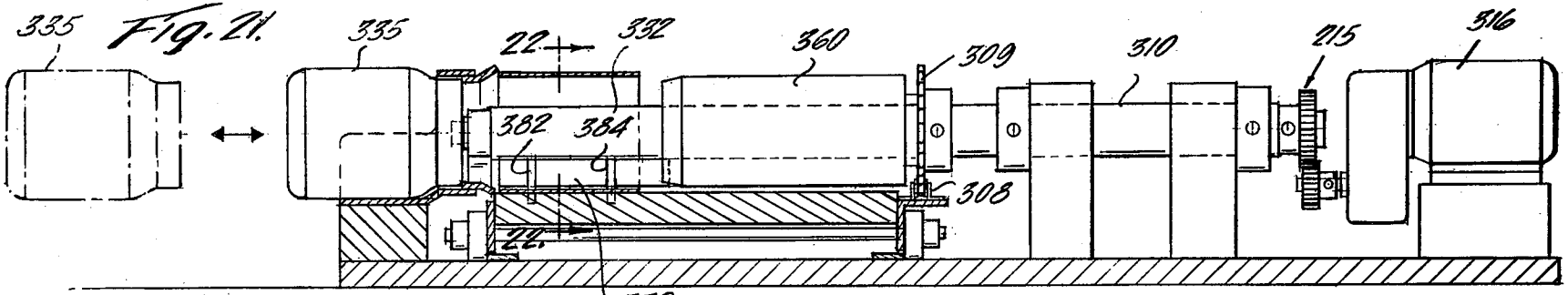
FIGS. 21 and 22 are sectional views taken along lines 21—21 and 22—22 of FIG. 20, respectively.
Figure 22:
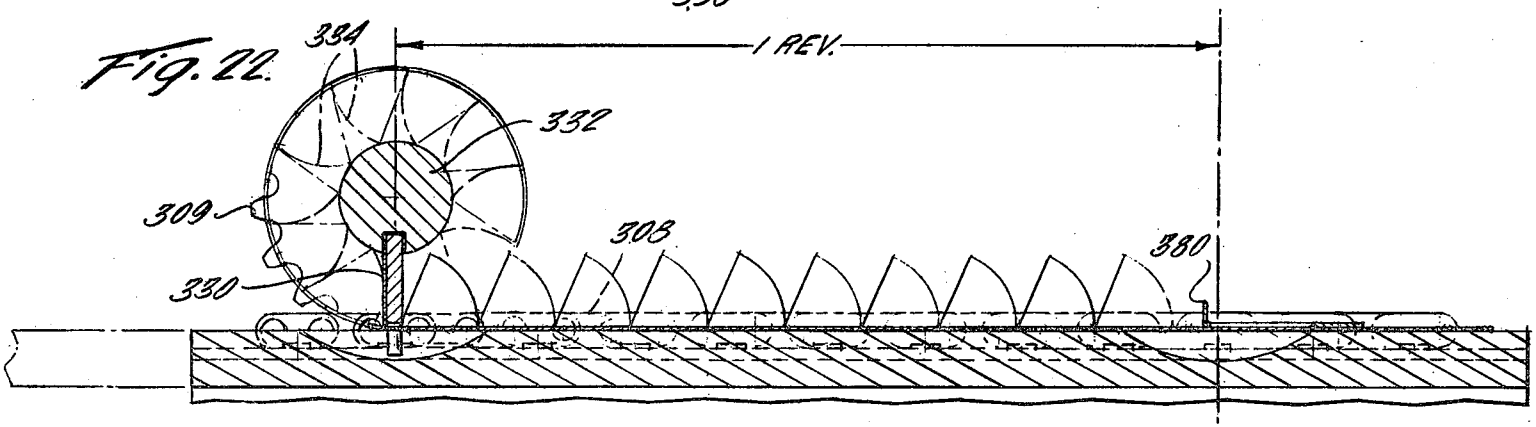
Figures 23, 24, 25, 26:
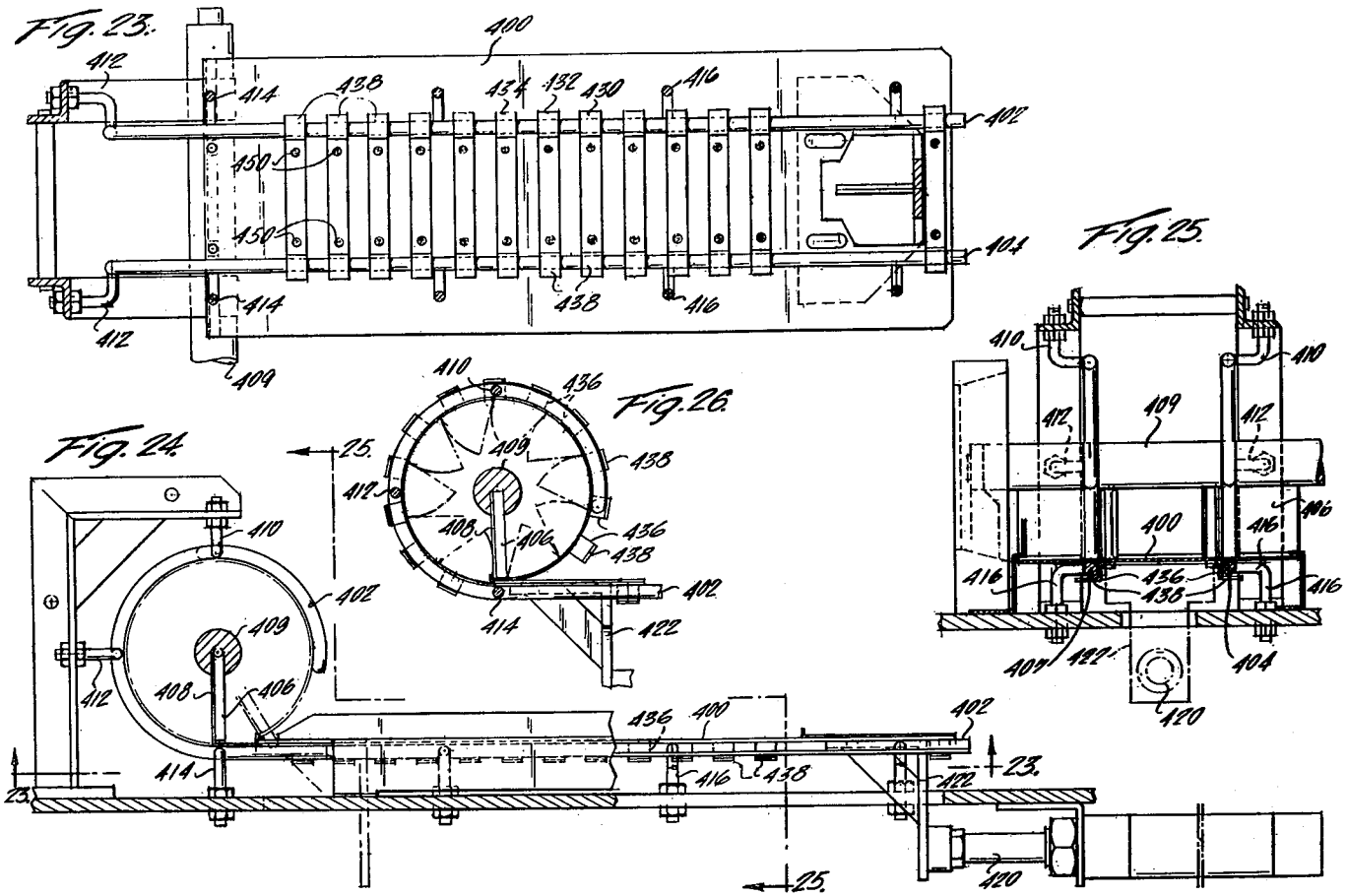
FIGS. 23, 24 and 25 are bottom, side and sectional views of another and preferred form of apparatus for accomplishing roll-up and unrolling of the belt or band, FIG. 26 being a fragmentary side view showing the band rolled up with cucumber spears in it.

FIG. 20 illustrates, somewhat schematically, an alternate type of apparatus for rolling up pickle spears or the like in a flexible belt to produce a cylindrical array of the pickle spears for discharge into a container. In this embodiment, a flexible belt 300 is secured near its upstream end to a movable table 306, which table is controlledly translatable longitudinally to the left in FIG. 20 during the roll-up procedure and translatable to the right during unrolling of the belt. This translation is accomplished by means of a rack 308 in the form of a length of chain secured to the table, driven by a sprocket wheel 309. The sprocket wheel 309 is rotated in one direction when roll up is desired, and in the opposite direction when unrolling is required. To effect this reciprocating rotational motion, a shaft 310 is provided which may be driven, through appropriate gearing 215, by an appropriate reciprocating rotational drive such as reversible motor 316, or it can even be rotated alternately in opposition directions manually, by means of an ordinary crank.

The front or leading end of the belt is provided with a perpendicular vane portion 330 extending radially into, and secured to, the central mandrel 332, which is also rotated by shaft 310 during the roll-up and unrolling steps. The translational motion of the table is thereby coordinated with the angular rotation of the mandrel so that the amount of belt supplied or withdrawn by the table motion is exactly that required to form a cylinder as the mandrel is turned. Pickle spears or similar food products placed side-by-side upon the flat belt will thereby be rolled up into a cylindrical array 334, as in the previously described embodiment, so that they can be pushed from the belt into a jar or similar container 335 by sliding of the cylindrical pusher 360 axially into the rolled-up belt. In this example the pickle spears extend completely across the spears between the inside of the roll-up belt 28 and the exterior of mandrel 332. The desired coordination between table motion and mandrel rotation is provided by driving the sprocket wheel 309 from the same source of rotation as is used to rotate the mandrel, the vane and sprocket sizes being selected to provide the above-mentioned feeding of the proper amount of belt to provide a cylindrical roll-up. It will be understood that in many practical embodiments it will be desirable to incorporate in this arrangement cylindrical guide means extending along the roll-up path to assure that the belt will always follow the desired cylindrical path, as in the previously-described embodiment, although in theory such guide means are not necessary or may be minimal. As in the previously described embodiment, a rear stop 380 and a pair of radial pins 382 and 384 are employed to achieve the desired close fit of the pickle spears between the front vane 330 and the rear stop 380.

Referring now to FIGS. 23–26, which show a presently-preferred form of the wrap-up arrangement, the flexible band 400 when unwound lies horizontally on guide means comprising a pair of parallel guide rods 402 and 404. At the forward ends of the guide rods (the left-hand ends in FIG. 24), the guide rods turn upwardly in a cylindrical configuration, so that when the opposite, trailing end of the band is urged horizontally to the left, the band slides along the guide rails until the forward end has been curled up into the cylindrical configuration shown in broken line in FIG. 25 and in full line in FIG. 26. Prior to this rolling-up of the band, the food spears are placed on the band as described previously with respect to other embodiments, and are wrapped-up into a cylindrical configuration by the action described, preparatory to being pushed into the receiving jar. The jar positioning system and the pusher system may also be as described previously.

As in other embodiments, the leading end of the band is bent into a right-angle position 408 and held by a radial vane 406 secured to rotatable mandrel 409. The guide rods are supported at their edges by support rods such as 410, 412, 414, 416. The pushing and pulling of the band during wrap-up and unwinding is produced by controlled reciprocation of actuator rod 420, which is secured to the band by bracket 422.

To provide positive guidance of the band against lateral motion and against upward or radially inward motion there are provided guide-contacting means in the form of a plurality of transverse metal strips such as 430, 432, 434 secured to the underside of the band at spaced intervals. Each strip is bent downwardly adjacent its ends as at 436 (FIG. 25), to provide guide surfaces slidable along the inner, opposed surfaces of the guide rods and thus preventing lateral motion of the band; the extreme ends of each strip are bent outwardly to provide guide surfaces slidable along the under surface of the guide rods as at 438 (FIG. 25), to secure the band against upward or lifting motion.

Each strip is held to the bottom of band 400 by a pair of rivets such as 450, and the strips are spaced apart sufficiently to permit easy curling of the band into and out of its rolled-up cylindrical configuration, without undue local stressing of the band material.

Accordingly, there has been provided a simple, reliable and fast-acting method and apparatus by which elongated food products such as segmented pickle spears may be placed side-by-side on a belt in predetermined relative orientation, rolled up inside a belt into a cylindrical configuration, and then slid from the belt into the container in which they are to be packed, with the food products in the desired orientations and relative positions around the interior periphery of the container, as desired. The roll-up process may be accomplished in a few seconds, and the pushing of the array into the jars may occur in an even shorter length of time, so that the overall packing procedure is very quick. The same equipment may be used to pack a substantial range of cross-sectional sizes of food products, and is readily adjustable and adaptable to even greater ranges of product types and dimensions by adjustment of the existing apparatus, or by substitution of a few resized parts.

It will be understood that the invention has been described with particular regard to specific embodiments thereof in the interest of complete definiteness, but it may be embodied in a variety of form diverse from those specifically shown and described without departing from the spirit and scope of the invention as defined by the appended claims.

What is claimed is:

1. The method of packing elongated food products into a cylindrical container, with said food products positioned side-by-side around the inner periphery of said container, comprising:

placing a horizontal row of said food products side-by-side adjacent each other on a substantially flat flexible belt;

rolling up said belt with said food products thereon into a cylindrical configuration, with said food products forming a cylindrical array about the interior of said rolled-up belt;

sliding said cylindrical array of food products axially out of said rolled-up belt into said container;

wherein said rolling-up of said belt comprises moving the leading edge of said belt and following portions thereof along a cylindrical path concentric with a predetermined axis positioned above the level of said belt when flat;

wherein said rolling-up of said belt comprises providing relative horizontal motion of the flat portion of said belt toward said axis at a speed so correlated with the rate of rolling-up of said belt as to provide said movement along said cylindrical path;

wherein said providing of relative motion comprises moving said belt while holding said axis translationally fixed;

said method also comprising positioning a mandrel along said axis, about which said belt and said food products thereon are rolled up; and wherein said moving of said leading edge of said belt comprises securing it to said mandrel at a constant distance therefrom during said rollling up of said belt.

2. The method of claim 1, comprising guiding said belt along said cylindrical path at a plurality of positions along it.

3. The method of claim 1, wherein said rolling up of said belt comprises driving said flat portion of said belt.

4. The method of claim 1, wherein said rolling up of said belt comprises driving said mandrel rotationally.

5. The method of claim 1, wherein said rolling up of said belt comprises both driving said flat portion of said belt and driving said mandrel rotationally.

6. Apparatus for packing similar cut pickle spears into a cylindrical container in a cylindrical array with the corresponding cut side of each spear positioned against the wall of said container, comprising:

a resilient flexible belt for receiving a horizontal stack of said spears side-by-side thereon when said belt is flat and horizontal, with the corresponding side of each spear facing downward toward said belt;

mandrel means positioned horizontally at a position higher than, and transverse to, said belt;

means securing a forward portion of said belt to said mandrel at a fixed radial distance therefrom;

means for moving said forward portion of said belt along a cylindrical path coaxial with the axis of said mandrel while providing relative motion of the flat portion of said belt toward a position directly below said axis, thereby to roll up said belt and said spears thereon into a cylindrical configuration coaxial with said mandrel axis, and with said spears maintained in their original relative positions and orientations with respect to said belt;

means for positioning said container with its cylindrical axis substantially collinear with said mandrel axis and with the open end of said container facing one end of said rolled-up belt;

means for pushing said spears simultaneously as a group out of said belt and through the mouth of said container to the interior thereof, while maintaining said spears in the same relative positions and orientations as when they were in said rolled-up belt; and means for unrolling said belt to its original flat configuration to receive another stack of spears for packing into another container.

7. The apparatus of claim 6, comprising a rear stop member extending upward adjacent the top of said belt at a position spaced rearwardly of the last spear in said horizontal stack prior to the beginning of said rolling-up.

8. The apparatus of claim 7, comprising means protruding from the underside of the leading end of said belt for contacting and urging into position on said belt any spear which may be cocked upward against said rear stop member as said rolling-up is being completed.

* * * * *